US011536061B2

(12) United States Patent
Sturm et al.

(10) Patent No.: US 11,536,061 B2
(45) Date of Patent: Dec. 27, 2022

(54) MOTOR VEHICLE DOOR LOCK

(71) Applicant: Kiekert AG, Heiligenhaus (DE)

(72) Inventors: Christian Sturm, Krefeld (DE); Holger Schiffer, Meerbusch (DE); Michael Scholz, Essen (DE); Bernhard Drost, Isselburg (DE)

(73) Assignee: Kiekert AG, Heiligenhaus (DE)

( * ) Notice: Subject to any disclaimer, the term of this patent is extended or adjusted under 35 U.S.C. 154(b) by 428 days.

(21) Appl. No.: 16/333,250

(22) PCT Filed: Aug. 18, 2017

(86) PCT No.: PCT/DE2017/100694

§ 371 (c)(1),
(2) Date: Mar. 28, 2019

(87) PCT Pub. No.: WO2018/050153

PCT Pub. Date: Mar. 22, 2018

(65) Prior Publication Data

US 2019/0249469 A1 Aug. 15, 2019

(30) Foreign Application Priority Data

Sep. 14, 2016 (DE) ..... 10 2016 117 280.4

(51) Int. Cl.
*E05B 83/24* (2014.01)
*E05B 81/70* (2014.01)
(Continued)

(52) U.S. Cl.
CPC ..... *E05B 83/24* (2013.01); *E05B 79/20* (2013.01); *E05B 81/15* (2013.01); *E05B 81/66* (2013.01);
(Continued)

(58) Field of Classification Search
CPC ..... E05B 83/24; E05B 83/16; E05B 85/24; E05B 85/243; E05B 85/20; E05B 85/26;
(Continued)

(56) References Cited

U.S. PATENT DOCUMENTS 10,682,932 B2 * 6/2020 Mosch ..... B60N 2/366
2002/0163207 A1 * 11/2002 Rogers, Jr. ..... E05B 83/16 292/216

(Continued)

FOREIGN PATENT DOCUMENTS

CA 2327139 A1 * 6/2001 ..... E05B 83/16
DE 19617428 A1 * 11/1997 ..... E05B 81/14

(Continued)

OTHER PUBLICATIONS

Computer Generated Translation for DE 102011114148, Generated on May 17, 2021, https://worldwide.espacenet.com/ (Year: 2021).*

(Continued)

*Primary Examiner* — Alyson M Merlino
(74) *Attorney, Agent, or Firm* — Renner, Otto, Boisselle & Sklar, LLP

(57) ABSTRACT

A motor vehicle door lock, particularly a motor vehicle bonnet lock, includes a ratchet mechanism which substantially consists of a rotary latch and a pawl. The ratchet mechanism interacts with a lock retainer pin on a vehicle bonnet. A retention element is additionally provided which holds the pawl in a retention position, raised from the rotary latch, during unlocking of the bonnet. The lock retainer pin continues to engage in the rotary latch when in said retention position. During a first opening process which proceeds from the retention position, the lock retainer pin transfers the retention element into a release position that releases the pawl. During a subsequent bonnet closing process, the pawl can thus engage in the rotary latch, which can be pivoted without exertion of force by the lock retainer pin at least into the hold position.

12 Claims, 6 Drawing Sheets

(51) Int. Cl.
*E05B 85/24* (2014.01)
*E05B 79/20* (2014.01)
*E05B 81/66* (2014.01)
*E05B 81/14* (2014.01)

(52) U.S. Cl.
CPC ..... *E05B 81/70* (2013.01); *E05B 85/243* (2013.01); *E05Y 2900/536* (2013.01)

(58) Field of Classification Search
CPC ..... E05B 79/20; E05B 81/15; E05B 81/66; E05B 81/68; E05B 81/70; E05B 81/72; E05B 83/18; E05B 77/16; E05B 77/36; E05B 77/38; E05B 77/42; Y10T 292/1044; Y10T 292/1047; Y10T 292/1048; Y10T 292/1057; Y10T 292/1059; Y10T 292/1078; Y10T 292/108; Y10S 292/14; Y10S 292/23; Y10S 292/42; Y10S 292/43; Y10S 292/56
See application file for complete search history.

(56) References Cited

U.S. PATENT DOCUMENTS

| | | | | |
|---|---|---|---|---|
| 2011/0031765 | A1* | 2/2011 | Vazquez | E05B 85/26 292/217 |
| 2012/0161456 | A1* | 6/2012 | Riedmayr | E05B 83/24 292/226 |
| 2012/0292927 | A1* | 11/2012 | Vazquez | E05B 81/68 292/200 |
| 2014/0246870 | A1* | 9/2014 | Kim | E05B 83/24 292/216 |
| 2015/0345186 | A1* | 12/2015 | Park | E05B 83/24 292/194 |
| 2016/0076279 | A1* | 3/2016 | Ilea | E05B 83/24 292/220 |
| 2016/0340941 | A1* | 11/2016 | Taurasi | E05B 83/24 |

FOREIGN PATENT DOCUMENTS

| | | | | |
|---|---|---|---|---|
| DE | 102006032033 | A1 | 3/2007 | |
| DE | 19938687 | B4 | 10/2007 | |
| DE | 102007008700 | A1 * | 8/2008 | E05B 83/16 |
| DE | 102009034904 | A1 * | 2/2011 | E05B 85/26 |
| DE | 102011114148 | A1 | 3/2013 | |
| DE | 102013113588 | A1 * | 9/2014 | E05B 83/24 |
| DE | 102014012112 | A1 | 2/2016 | |
| DE | 102014218529 | A1 * | 3/2016 | E05B 85/26 |
| EP | 2067917 | A2 * | 6/2009 | E05B 77/36 |
| KR | 101542689 | B1 * | 8/2015 | |
| KR | 101643468 | B1 * | 7/2016 | |
| WO | 2014/036991 | A2 | 3/2014 | |

OTHER PUBLICATIONS

International Search Report and Written Opinion for corresponding Patent Application No. PCT/DE2017/100694 dated Oct. 30, 2017.

* cited by examiner

MOTOR VEHICLE DOOR LOCK

FIELD OF DISCLOSURE

The invention relates to a motor vehicle door lock, particularly a motor vehicle bonnet lock, provided with a ratchet mechanism, which substantially consist of a rotary latch and pawl. The ratchet mechanism interacts with a lock retainer pin on a vehicle bonnet. A retention element is additionally provided which holds the pawl in a retention position raised from the rotary latch during unlocking of the bonnet.

BACKGROUND OF DISCLOSURE

Motor vehicle door locks and in particular motor vehicle bonnet locks are known in many embodiments from practice and are described by way of an exemplary embodiment in DE 199 38 687 B4. This is about a so-called catch hook lock, which in addition to a pawl to secure the rotary latch of the locking mechanism also features a catch hook. When closing a bonnet, a door, or a cover with the lock retainer pin arranged thereon, the catch hook in question is pivoted into its closed position, in which it engages behind the locking bolt or lock retainer pin. The locking bolt or lock retainer pin is thus double secured, on the one hand by the rotary latch held in the closed position by mechanism of the pawl and on the other hand by said catch hook.

In order to now open such a catch hook lock, in practice a regular procedure is followed in which an unlocking/opening mechanism is provided for action on the rotary latch. The unlatching/opening mechanism generally has a handle provided in the interior of a motor vehicle body. With the help of the handle, the locking mechanism can be unlatched and opened.

In order to be able to open the hood or bonnet now, it is also necessary to pivot the catch hook still securing the lock retainer pin so that the lock retainer pin and thus the bonnet is released. The pivoting of the catch hook is carried out usually by the driver, who must reach through a gap between the body and the bonnet on the front of the vehicle to operate the catch hook. This gap comes about by the fact that the bonnet is placed upright after unlatching and opening the locking mechanism with the help of at least one spring defining the gap. Such a procedure is cumbersome.

For this purpose, a closing device for a bonnet has been proposed, for example, in DE 10 2014012 112A1, which allows for opening the bonnet solely by operating twice an operating lever inside the motor vehicle. This is intended to make available a special suitability for bonnets of motor vehicles. The solution proposed for this purpose uses a drive for a swing arm, among others, which is used to move the locking mechanism in whole or in part so that a door gap or bonnet gap can be reduced or increased. In addition, the operating device for unratcheting the locking mechanism is also equipped with a coupling. This results in a relatively complex and complicated mechanical construction, which can possibly lead to functional impairments.

In the case of the largely general state of the art according to WO 2014/036991 A2, the procedure is such that the local motor vehicle door lock is equipped with a release element for the locking mechanism and a retention element. The retention element ensures an unimpeded opening movement of the rotatory latch from a closed position to an open position. For this purpose, the retention element maintains the release element in an ineffective position with regard to the locking mechanism during the opening movement of the rotary latch. The same applies to the pawl, because a blocking lever alternately acting with the pawl is assigned to the release element. In this way, the greatest possible reliability is to be provided with a structurally simple design.

DE 10 2006 032 033 A1 describes a comparable state of the art design, where the retention element ensures that, in the retention position, the pawl is held in its release position when the rotary latch is turned out of its closed position and after it passes the pre-ratchet position.

The state of the art cannot satisfy in all aspects. Thus, in the case of motor vehicle bonnet locks, there is the problem that operators often tend to lower the relevant door, bonnet or cover so slowly after an opening operation that the motor vehicle door lock or motor vehicle bonnet lock installed generally in the front area of the motor vehicle does not snap into place. In this case, the lock retainer pin is not secured to the bonnet. This is problematic insofar as such a state of the bonnet is often not detected and the vehicle operator drives or tries to drive off with the motor vehicle. This can cause safety problems, for example, the bonnet may flip open while driving, either by wind or gusts of wind, and abruptly block the driver's view to the front.

In addition to such safety problems, for reasons of comfort, designs are nowadays preferred in which the bonnet or front hood can be opened simply by using an operating lever or the handle as a component of the unlocking/opening mechanism for the lock. At this point, a two-time operation is usually needed, as described in the aforementioned DE 10 2014 012 112 A1. However, this design is complex. The invention intends to provide an overall remedy here.

SUMMARY OF DISCLOSURE

The invention is based on the technical problem of further developing such a motor vehicle door lock so that functional reliability is increased while using a structurally simple design at the same time.

To solve this technical problem, a generic motor vehicle door lock and in particular a motor vehicle bonnet lock within the scope of the invention is characterized in that the lock retainer pin arranged on the bonnet in the retention position still continues to drop into the rotary latch and that the retention element during the first opening operation, starting from the retention position, transfers it to a release position that releases the pawl. In this way, a subsequent closing operation of the hood can then cause the pawl to drop into the rotary latch which can be swiveled without force by the lock retainer pin to the retention position.

In general, within the scope of the invention, the procedure is such that the locking mechanism is acted upon with the help of an unlatching/opening mechanism. The unlatching/opening mechanism typically has a handle provided in the interior of the motor vehicle body. In a first operation of the handle, the locking mechanism is generally transferred to a pre-ratchet position. In this pre-ratchet position, the lock retainer pin is still held and secured with the aid of the rotary latch and the pawl which is in the pre-ratchet. The same applies to the bonnet.

The term bonnet in the scope of the invention includes any flap element on or in a motor vehicle, so not only a front hood, but also a motor vehicle door, a motor vehicle side door, a tailgate, a trunk lid, and even a fuel filler flap. In any case, a first operation of the handle provided in the interior of the motor vehicle body ensures that the locking mechanism assumes its pre-ratchet position. In the pre-ratchet position, the bonnet or front hood continues to be still secured.

The pre-ratchet position corresponds to the fact that the locking mechanism has been opened slightly or the rotary latch has carried out a slight opening movement.

The bonnet or front hood is accordingly flipped open opposite the vehicle body and defines a gap. Consequently, the pre-ratchet position corresponds to the fact that the sealing pressure of an encircling seal which seals the bonnet in the example case in relation to the motor vehicle body is reduced. Consequently, the bonnet or front hood can be unlatched by a second operation of the handle and subsequently opened easily. Since the first and second operation of the handle are made from the interior of the vehicle body, the bonnet or front hood can thus be opened completely by an internal operation. This is particularly comfortable compared to the catch hook latches previously used in practice.

In addition, a significant increase in safety is observed. For if an operator lowers the open bonnet—even if this is done very slowly—the lock retainer pin is able to pivot the open rotary latch without applied force to at least the retention position. The retention position corresponds to the pre-ratchet position of the locking mechanism or the rotary latch. Since the previous opening process of the bonnet has transferred the pawl, which was before in the retention position and has been lifted off from the rotary latch, to its release position, the pawl can drop into the rotary latch swiveled without applying force by the lock retainer pin to the pre-ratchet or retention position during the described closing operation following the opening operation of the bonnet. Such a situation where the bonnet or front hood is lowered back onto the vehicle without the locking mechanism engaging and at least holding and securing the lock retainer pin in the pre-ratchet position is therefore not possible.

The reason for this is as follows. After the first operation of the handle inside the vehicle body, the locking mechanism is transferred to the pre-ratchet position. In the pre-locked position, the lock retainer pin still drops into the rotary latch. The bonnet is released and can be slightly opened up under the definition of the previously mentioned gap between the vehicle body and the bonnet. This is ensured by at least one of the springs acting on the bonnet or the rotary latch.

The force of the spring is now dimensioned in such a way that the lock retainer pin still drops into the rotary latch as before even when in the retention position. The retention position is reached or assumed from the pre-ratchet position because the bonnet is being unlatched. For this purpose, the handle provided in the interior of the motor vehicle body is operated for the second time.

The second operation of the handle causes the pawl being lifted from the pre-ratchet on the rotary latch. Due to the specific design of the spring acting on the bonnet in the opening sense, the lock retainer pin continues to drop into the rotary latch when in the thus assumed retention position. The bonnet thus is suspended, so to speak, while maintaining the gap to the motor vehicle body over this motor vehicle body. The retention element now ensures that the pawl is held in the retention position lifted off from the rotary latch during the respective unlatching operation of the bonnet.

If now the unlatched bonnet is to be opened, an operator can easily reach through the gap and grasp the bonnet and swing it open. Here, the rotary latch is pivoted to its open position. Since the pawl is held in the retention position lifted off from the rotary latch with the help of the retention element, the rotary latch can pivot freely and immediately releases the lock retainer pin. The same applies to the bonnet.

In this first opening process starting from the retention position, the lock retainer pin, which has dropped into the rotary latch in the retention position, ensures that the pawl is transferred to the releasing release position. This means that the lock retainer pin dropped into the rotary latch controls the pawl in such a way that it relinquishes its lifted off retention position and is transferred to the releasing release position. Since in the respective first opening operation the rotary latch is simultaneously swiveled from the pre-ratchet position into the open position with the aid of the lock retainer pin acting in the opening direction, the pawl transferred to the release position cannot (any longer) interact with the rotary latch, but lies on the outside of the rotary latch without the possibility of interaction.

In a closing operation of the bonnet subsequent to the opening operation described, the lock retainer pin drops without any force exerted at least into the rotary latch pivotable to the pre-ratchet position. Because this pre-ratchet position corresponds to the position in which the bonnet or front hood is held in a suspended position, so to speak, compared to the vehicle body. As a result, it is ensured that even when the bonnet is lowered very slowly, the lock retainer pin pivots the rotary latch at least to the pre-ratchet position. Since the pawl is in the releasing release position, it can at least latch into the pre-ratchet on the rotary latch. As a result, the lock retainer pin, and with it the bonnet, is secured. An unintentional flipping up of the bonnet or front hood even with a subsequent driving operation is not possible.

In this case, it is understood that the rotary latch located in the pre-ratchet position or the locking mechanism and consequently the bonnet flipped open with respect to the motor vehicle body, taking account of the gap, can additionally be queried with the aid of a sensor or switch. Its signal can be output visually and/or acoustically in the interior of the motor vehicle as a warning to the driver. At least such a warning signal can be emitted if the motor vehicle is to be started in this pre-ratchet position of the locking mechanism. These are the main advantages of the invention.

According to an advantageous embodiment, the pawl acting on the retention element is mounted on a shift lever. The shift lever in turn usually protrudes into an inlet mouth of the locking mechanism and rests against the lock retainer pin (continuous). This may be ensured by a spring pre-tensioning the shift lever in the direction of its contact on the lock holder bracket.

The shift lever is usually a two-arm lever. In fact, the shift lever has a stop arm resting against the lock retainer pin and a bearing arm supporting the retention element. The retention element is rotatably mounted on the bearing arm. The retention element is a memory lever equipped with a blocking arm interacting with the pawl and a control arm interacting with the shift lever.

The memory lever is generally biased towards the retention position by mechanism of a spring. After lifting the pawl off the rotary latch during unlatching, starting from the pre-ratchet position of the locking mechanism, the retention element moves with its blocking arm supported by the spring against the pawl. As a result, the pawl is held in this retention position. For this purpose, the pawl is equipped with a stop pin.

The stop pin on the pawl ensures in the pre-ratchet position of the locking mechanism following the first operation of the handle inside the motor vehicle body that the retention element or the memory lever cannot pivot into the retention position. For this purpose, the relevant stop pin of the pawl in question interacts with a side face of the respective blocking arm of the retention element. However, as soon as the pawl is acted on from the pre-ratchet position by the second operation of the handle provided inside the vehicle body, the stop pin on the pawl moves along the side surface of the blocking arm of the retention element. At the end of this movement, the retention element is swiveled to the retention position by mechanism of the spring.

At the same time, the stop pin of the pawl abuts against a front surface of the blocking arm. As a result, the retention element now in the retention position ensures that the pawl is held in this lifted position with respect to the rotary latch. This is ensured by the stop pin on the front surface of the blocking arm. The blocking arm of the retention element is thus advantageous in the retention position on the described stop pin of the pawl.

As soon as the bonnet is opened, starting from this retention position, the lock retainer pin, which continues to engage in the retention position in the rotary latch, ensures that the pawl is transferred to its releasing release position. For this purpose, the lock retainer pin pivots not only the rotary latch, starting from the pre-ratchet position to the open position, but the spring-supported shift lever on the lock retainer pin also follows the opening movement of the lock retainer pin.

Together with the switch lever which simultaneously swivels the lock retainer pin in the opening direction, the storage lever or the retention element mounted on it is also swiveled. This pivoting movement of the retention element together with the shift lever has the result that the front surface of the blocking arm of the retention element is removed from the stop pin of the pawl. Once the stop pin of the pawl is released from the front surface of the blocking arm, the pawl is spring-assisted transferred to its releasing release position.

As a result, a motor vehicle door lock and in particular a motor vehicle bonnet lock is provided, which brings significant safety advantages and at the same time is structurally simple. Because next to the locking mechanism, only the shift lever and the memory lever mounted thereon are required. Additional drives are not needed. As a result, functional reliability is increased at the same time. These are considered the main advantages.

BRIEF DESCRIPTION OF DRAWINGS

In the following the invention will be explained in more detail with reference to a drawing showing only one exemplary embodiment.

DETAILED DESCRIPTION

Figure 1A:
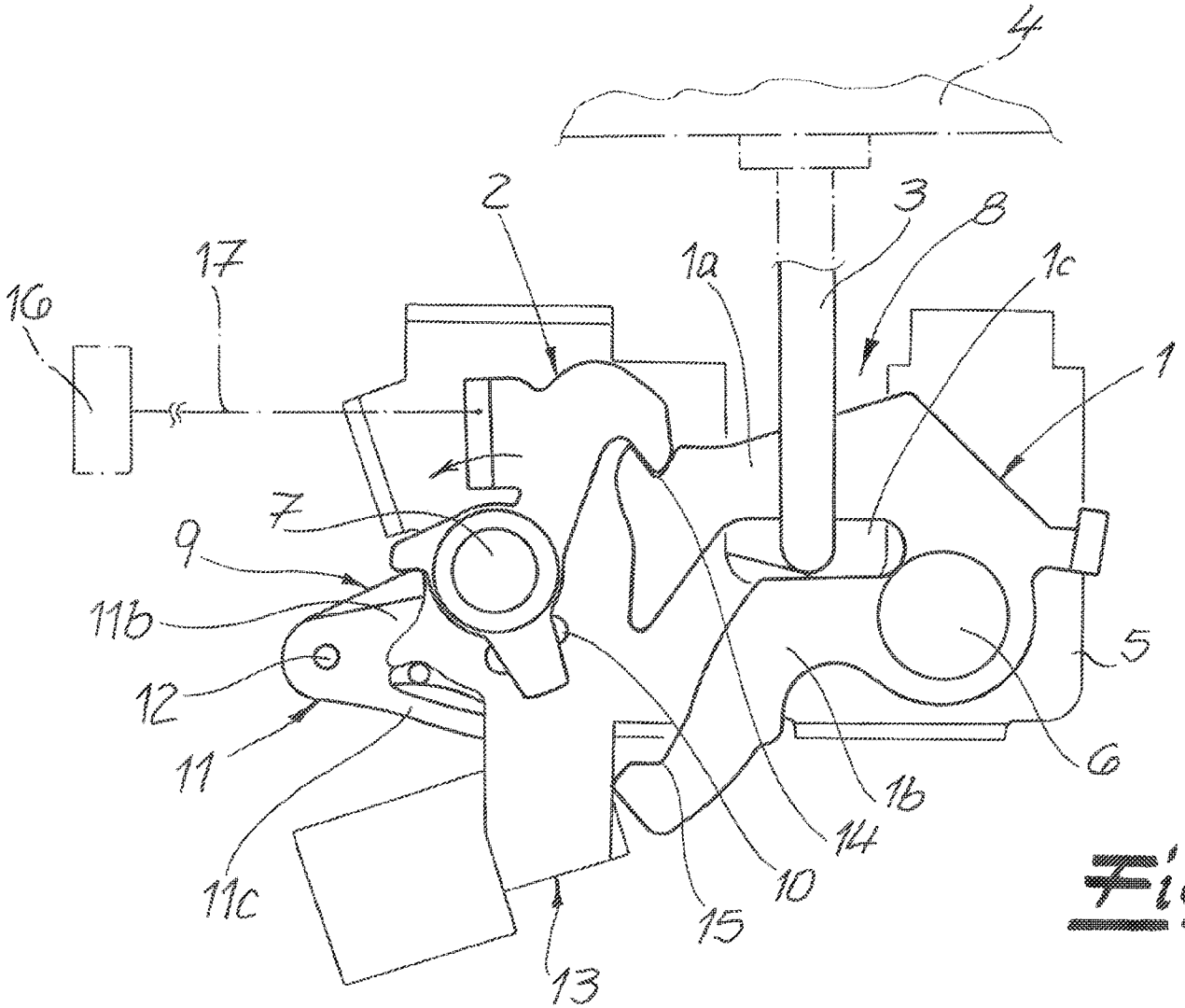
FIGS. 1A and 1B depict the motor vehicle door lock according to the invention on the one hand from the rotary latch side (FIG. 1A) and on the other hand from the memory lever side (FIG. 1B) in the closed state or in the main position, FIGS. 2A and 2B vehicle door lock according to FIGS. 1A and 1B in the pre-ratchet position, again with a view to the rotary latch side (FIG. 2A) and the memory lever side (FIG. 2B), and FIGS. 3A and 3B the motor vehicle door lock in the retention position and in an indicated opening operation, again with regard to the rotary latch side (FIG. 3A) and the pawl side (FIG. 3B).

In the figures, a motor vehicle door lock is shown, which is not limited to a motor vehicle bonnet lock. The respective motor vehicle door lock is therefore located in the front area of a not depicted motor vehicle. The motor vehicle door lock has a locking mechanism 1,2 consisting essentially of a rotary latch 1 and a pawl 2. Rotary latch 1 is a fork latch with two fork arms 1*a*, 1*b* and a slot 1*c* defined between the fork arms 1*a* and 1*b* for accommodating and holding a lock retainer pin 3. The lock retainer pin 3 is connected to a bonnet 4 or front hood 4 of the motor vehicle (not shown), which is indicated only in FIG. 1A.

Rotary latch 1 is mounted with the aid of a pin or shoulder stud rotatable relative to a frame plate 5 defining an axis 6. Pawl 2 is rotatably mounted relative to the frame plate 5. Also in this case a pin or shoulder stud accommodating the pawl 2 defines a corresponding axis or axis of rotation 7. Frame plate 5 is equipped with an inlet mouth 8, via which the lock retainer pin 3 extends into and retracts from the motor vehicle door lock or the locking mechanism 1.2.

In addition, a retention element 9 depicted in particular in the rear view according to FIGS. 1B to 3B, which is a memory lever 9, is also part of the basic design. The retention element or the memory lever 9 has a blocking arm 9*a* and a control arm 9*b*. The blocking arm 9*a* can interact with the pawl 2 or a stop pin 2*a* on the pawl 2, as can be seen in particular in FIGS. 1B to 3B. For this purpose, the stop pin 2*a* passes through the frame plate 5 in the region of a recess 10.

The retention element or the memory lever 9 is rotatably mounted on a shift lever 11. This is ensured by a rotation axis 12. In addition, the retention element or the memory lever 9 is biased by mechanism of a spring, not explicitly shown in the direction of its retention position to be explained below. For this purpose, the spring in question ensures that the retention element or the memory lever 9 is biased in the direction of a clockwise movement about its axis or axis of rotation 12 on the shift lever 11. This is indicated by a corresponding arrow in FIGS. 1B to 3B.

Figure 2A:
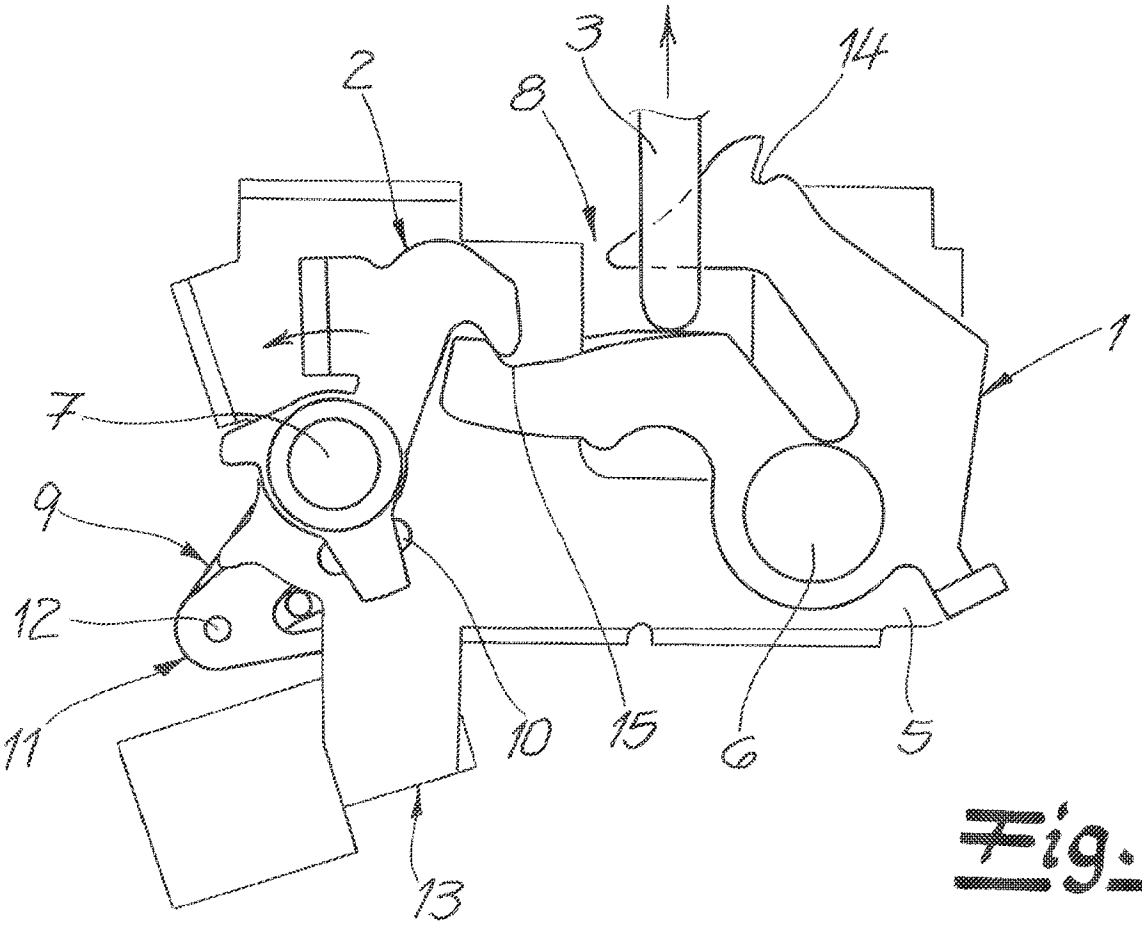
Figure 2B:
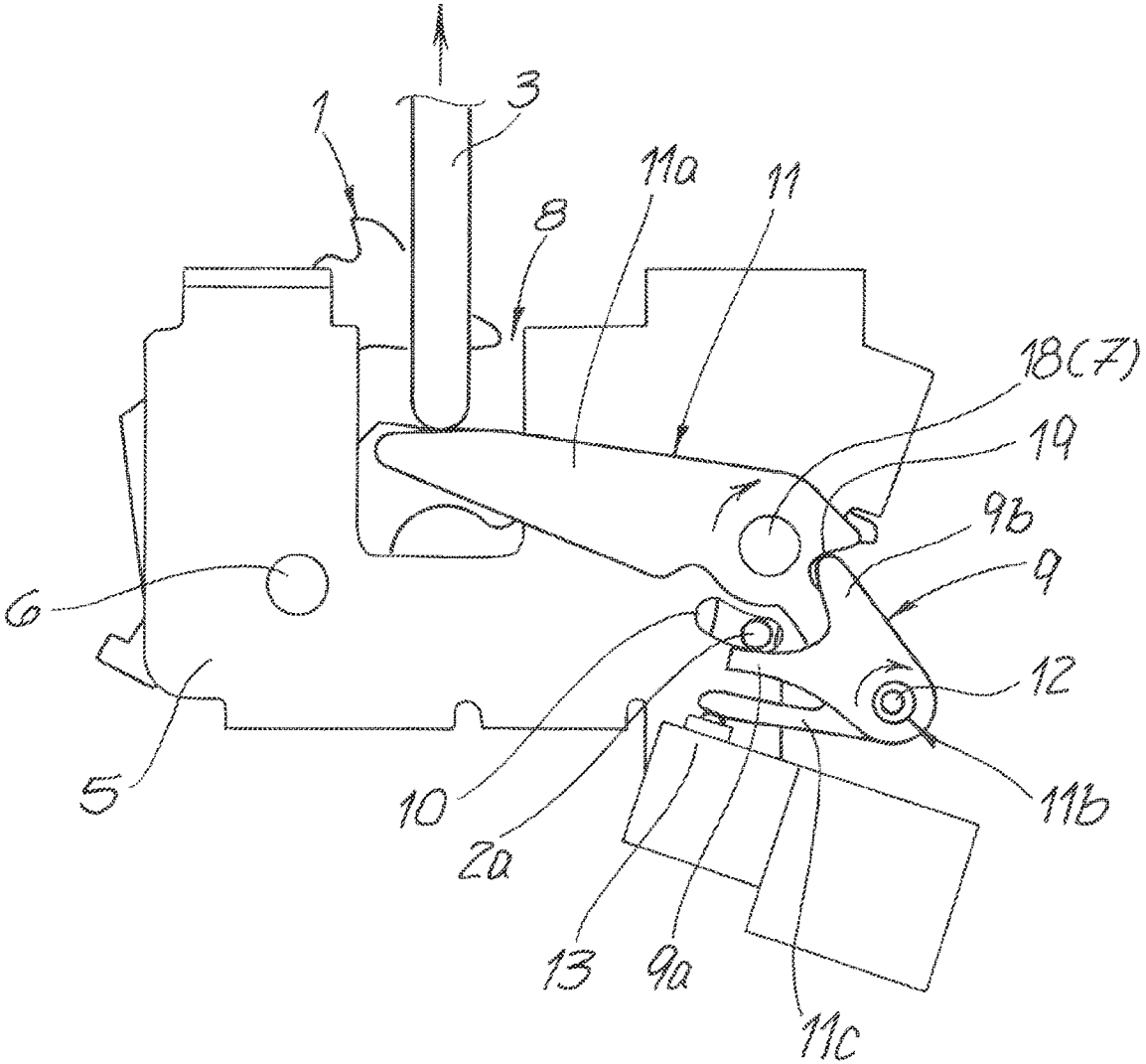
Figure 3A:
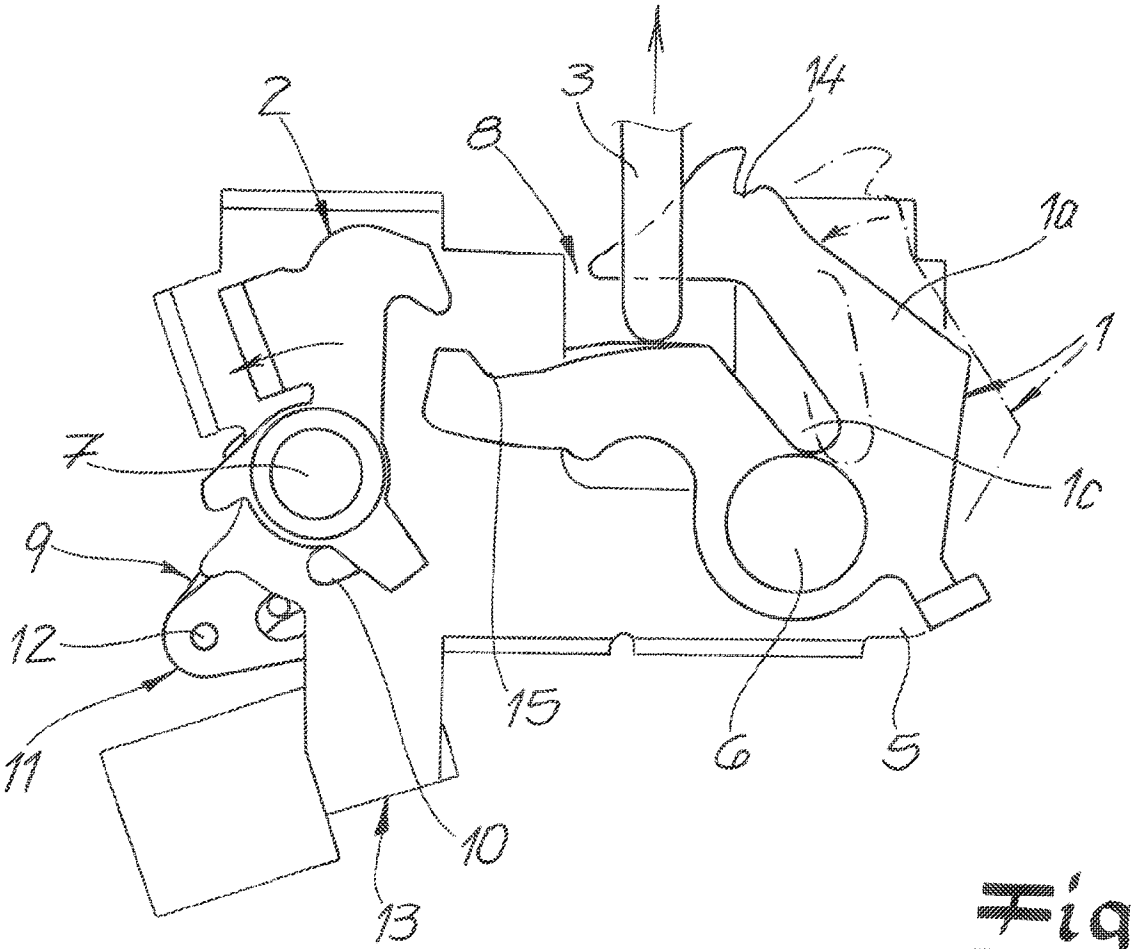
Figure 3B:
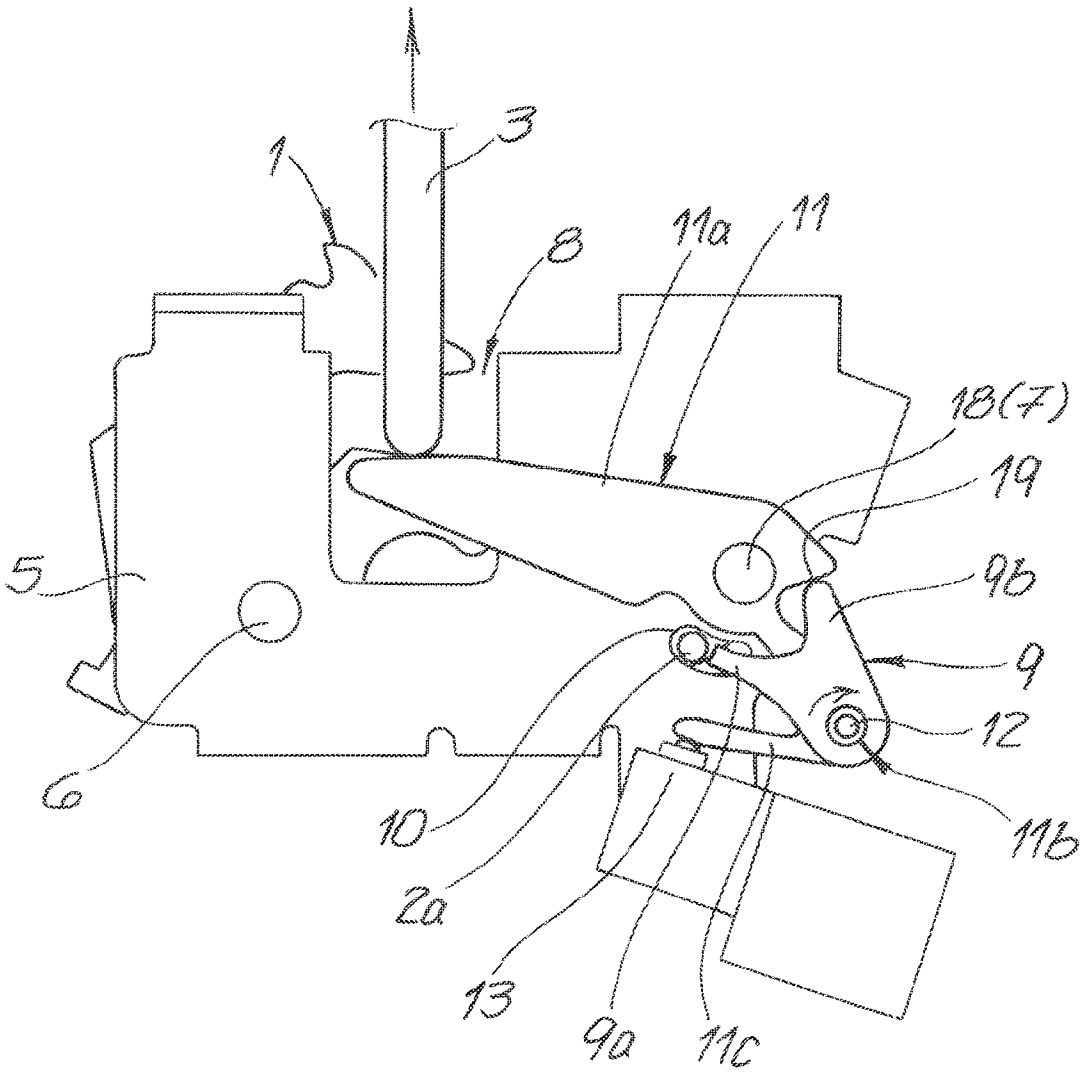

During an unlatching operation of the bonnet 4, the pawl 2 is held in a retention position lifted from the rotary latch 1 as shown in FIGS. 3A and 3B. In this retention position, the locking mechanism 1.2 is still in its pre-ratchet position, which is reproduced in FIGS. 2A and 2B. In the pre-ratchet position of the locking mechanism 1, 2 or the retention position of the pawl 2, the lock retainer pin 3 still dropped into the rotary latch 1 as before. This can be seen in a comparative view of FIGS. 2A, 3A and 2B and 3B, respectively.

Shift lever 11, which is part of the basic design and has already been mentioned, is designed as a two-arm lever. In fact, the shift lever 11 has a stop arm 11*a* adjacent to the lock retainer pin 3 and a bearing arm 11*b* supporting the retention element 9. According to the exemplary embodiment, the shift lever 11 is additionally equipped with a sensor arm 11*c*, which interacts with a sensor 13 in certain positions of the shift lever 11. Sensor 13 is a microswitch in the exemplary embodiment and is not restrictive.

Finally, an unlatching/opening mechanism 16, 17 for acting on the locking mechanism 1.2 is provided as well. The unlatching mechanism 16, 17 is indicated only in FIG. 1A. In fact, the unlatching/opening mechanism 16, 17 engages the pawl 2 as part of the locking mechanism 1,2.

In the exemplary embodiment, the unlatching/opening mechanism 16, 17 has a handle 16 provided in the interior of a motor vehicle body on the one hand and a connecting element 17 mechanically coupling the handle 16 with the pawl 2 on the other hand. The connecting element 17 is a cable or Bowden cable. With the aid of handle 16, the locking mechanism 1,2 or pawl 2 can be acted on from the inside of the vehicle body. A respective operation of the handle 15 corresponds to a pulling acting on the connecting mechanism 17, which corresponds to the fact that the pawl 2 is acted upon about its axis or axis of rotation 7 in the counterclockwise direction indicated in FIG. 1A.

According to the exemplary embodiment and particularly preferable is that the handle 16 is operated twice. During a first operation of the handle 16, the locking mechanism 1,2 moves from the main-ratchet position of FIGS. 1A, 1B into the pre-ratchet position shown in FIGS. 2A and 2B. In the pre-ratchet position, the bonnet 4 is slightly pushed out. This is ensured by a spring, not shown, which may act on the bonnet 4 directly in the opening direction. In principle, the spring can also act on the rotary latch 1. The overall design is made so that the bonnet 4 is held in the pre-ratchet position according to FIGS. 2A and 2B, as it were suspended, i.e., is not acted upon by the spring in the opening sense. As a result, the lock retainer pin 3 remains in the slot 1*c* between the two fork arms 1*a*, 1*b* of the rotary latch 1. The lock retainer pin 3 and thus the bonnet 4 are logically secured in the pre-ratchet position according to FIGS. 2A and 2B as before.

Figure 1B:
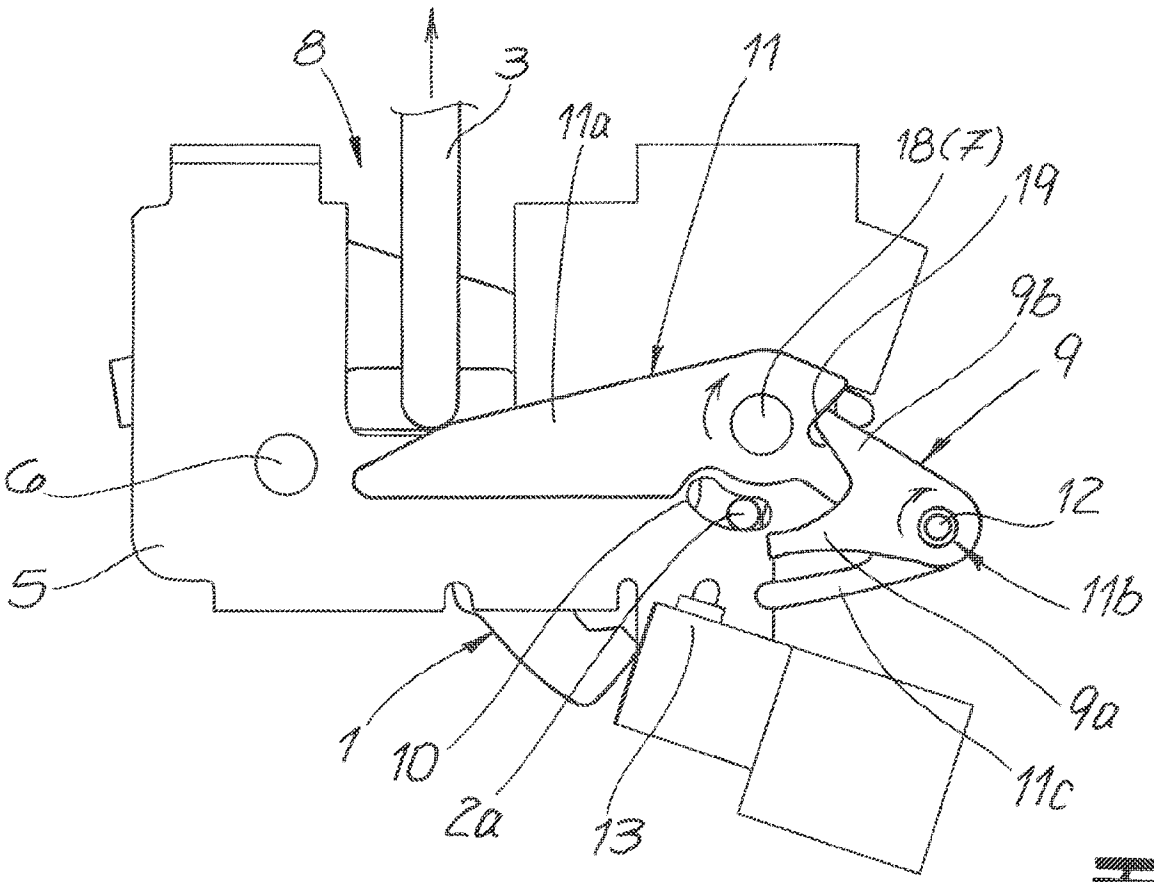

For the transition from the closed position of the motor vehicle door lock according to FIGS. 1A and 1B to the pre-ratchet position according to FIGS. 2A and 2B, the handle 16 is operated for the first time. As a result, the pawl 2 is acted upon counterclockwise about its axis 7 and exits a main-ratchet 14 on the fork arm or main-ratchet arm 1*a* of the rotary latch 1. After the first operation of the handle 16, the handle 16 together with the connecting means 17 and the pawl 2 is reset with the help of the spring, so that the pawl 2 in the then reached pre-ratchet position according to FIGS. 2A and 2B can interact with a pre-ratchet 15 on the additional fork arm or pre-ratchet arm 1*b* of the lock 1. The lock retainer pin 3 is still in the slot 1*c* between the two fork arms 1*a*, 1*b* of the rotary latch 1. In the pre-ratchet position, the locking mechanism 1,2 thus continues to ensure securing of the lock retainer pin 3 and consequently of the bonnet 4.

To assume the retention position shown in FIGS. 3A and 3B, the bonnet 4 is unlatched. For this purpose, a second operation of the handle 16 corresponds. As a result of this unlatching, the retention position shown in FIGS. 3A and 3B is assumed. In fact, this second operation of the handle 16 of the unlatching/opening mechanism 16, 17 corresponds to the fact that the pawl 2 is again pivoted counterclockwise about its axis 7 starting from the pre-ratchet position according to FIGS. 2A and 2B. However, after the handle 16 has been operated for the second time, the pawl 2 does not spring-supported return to its home position shown in FIGS. 1A and 2A. This is ensured by the retention element or memory lever 9. This can be seen in the sequence of functions in the rear views or when looking at the memory lever side according to FIGS. 1B to 3B.

During the transition from the closed position according to FIG. 1B to the retention position corresponding to the illustration in FIG. 3B, the shift lever 11 makes a pivoting movement in the clockwise direction about its axis 18.

Actually, the shift lever 11 is supported in the frame plate 5 on the memory lever side. This may again be handled by a pin or bolt, which defines the axis or axis of rotation 18 for the two-armed shift lever 11.

The shift lever 11 protrudes into the inlet opening 8 of the frame plate 5 and can thereby interact with the lock retainer pin 3 or is in continuous contact with the lock retainer pin 3. This is ensured by a spring 11 which acts on the shift lever 11 and biases the shift lever 11 in the clockwise direction indicated in FIG. 1B with respect to rotations about its axis 18, as indicated by a corresponding arrow. The corresponding spring is not shown here.

During the transition of the locking mechanism 1, 2 from the closed position according to FIGS. 1A and 1B to the pre-ratchet position according to FIGS. 2A and 2B, the lock retainer pin 3 moves in an opening sense, i.e., out of the inlet opening 8, as indicated by arrows. This is ensured by the previously mentioned spring, which acts on the bonnet 4, respectively the rotary latch 1. As a result, a gap is observed between the bonnet 4 and the motor vehicle body, not shown, in the pre-ratchet position shown in FIGS. 2A and 2B, through which an operator can grasp the bonnet 4 and open it completely from the pre-ratchet position.

During the transition from the closed position of the locking mechanism 1, 2 according to FIGS. 1A, 1B to the pre-ratchet position according to FIGS. 2A and 2B, the shift lever 11 follows the upward movement of the lock retainer pin 3 in the exemplary embodiment. As a result, the shift lever 11 in this case performs a pivoting movement in the clockwise direction about its axis 18. The memory lever or retention element 9 mounted on the shift lever 11 and rotatable about its axis 12 follows this pivoting movement of the shift lever 11. As already explained above, the retention element or the memory lever 9 is biased by a spring in the direction of the retention position, i.e., clockwise about its axis 12.

During the transition from the closed position to the pre-ratchet position, the memory lever 9 is now locked in its position opposite the shift lever 11 because, on the one hand, its control arm 9*b* rests against a stop 19 of the shift lever 11 and, on the other hand, a side surface of the blocking arm 9*a* rests against the stop pin 2*a* of pawl 2. This makes clear in particular the functional position according to FIG. 2B.

In the pre-ratchet position according to FIGS. 2A and 2B, the completed clockwise movement of the shift lever 11 additionally has the effect that the sensor arm 11*c* acts on the microswitch 13 in the exemplary embodiment. The signal of the sensor or microswitch 13 can be emitted as a warning signal inside the motor vehicle, indicating that the bonnet 4 is not completely closed. In addition, this signal can be evaluated so that the associated motor vehicle, for example, cannot be driven off.

As already explained, the transition from the closed position according to FIGS. 1A and 1B to the pre-ratchet position. 2A and 2B is initiated and started by the first operation of the handle 16 provided in the interior of the motor vehicle body.

Because this first operation of the handle 16 ensures that the pawl 2 is lifted from the rotary latch 1 or the main-ratchet 14. As a result, the bonnet 4 is raised slightly with the help of the spring and the locking mechanism 1, 2 switches over into the pre-ratchet position according to FIGS. 2A and 2B. Because following the first operation of the handle 16, the pawl 2 can fall into the pre-ratchet 15 of the rotary latch 1.

If now starting from the pre-ratchet position according to FIGS. 2A and 2B, the bonnet is unlatched or is to be unlatched, a second operation of the handle 16 must take place. This second operation of the handle 16, starting from the pre-ratchet position according to FIGS. 2A and 2B, has the result that the pawl 2 in turn is pivoted counterclockwise about its axis 7 and consequently exits the pre-ratchet 15. Since the force of the spring acting on the bonnet 4 is dimensioned such that the bonnet 4 is held in suspension in the pre-ratchet position, the bonnet 4 does not (anymore) open from the pre-ratchet position according to FIGS. 2A and 2B in the transition to the retention position according to FIGS. 3A and 3B. Rather, the lock retainer pin 3 drops into the rotary latch 1 in the retention position according to FIGS. 3A and 3B as before. Rotary latch 1 thus retains its pre-ratchet position.

By the second operation of the handle 16, starting from the pre-ratchet position according to FIGS. 2A and 2B, the pawl 2 is now lifted from the rotary latch 1 in the pre-ratchet position. This counterclockwise pivoting movement of the pawl 2 about its axis or axis of rotation 7 in the rear view or when looking at the memory lever side and when comparing FIGS. 2B and 3B results in that the stop pin 2*a* on the pawl 2 moves along the side surface of the blocking arm 9*a* of the pawl 9 and, at the end of the counterclockwise movement of the pawl 2 about its axis 7, reaches a front surface of the blocking arm 9*a* of the memory lever 9. This is ensured by the spring acting on the locking lever 9 clockwise around axis 12. The memory lever 9 maintains this position due to the interaction of its control arm 9*b* with the stop 19 on the shift lever 11. Since the stop pin 2 a of the pawl 2 is moved against the front surface of the blocking arm 9*a* of the retention element 9 and the retention element 9, maintains the retention position shown in FIGS. 3A and 3B, the pawl 2 is lifted out of the rotary latch 1 in this retention position.

In a first opening operation of the bonnet 4, starting from the retention position shown in FIGS. 3A and 3B, the lock retainer pin 3 ensures that the pawl 2 is transferred to a releasing release position. In this release position, the pawl 2 is free of the retention element or storage lever 9 and is again in its initial position as shown in FIGS. 1A and 2A.

To achieve this in detail, the opening process of the bonnet 4, starting from the retention position shown in FIGS. 3A and 3B, first ensures that the lock retainer pin 3 is moved upwards. For this purpose, an operator reaches through the gap between the bonnet 4 and the vehicle body. This gap has automatically resulted or has been set in the pre-ratchet position according to FIGS. 2A and 2B, as has already been explained above. As a result of the opening movement of the bonnet 4 and thus the connected lock retainer pin 3, the shift lever 11 is also further pivoted clockwise about its axis 18, as indicated in FIG. 3B. The pivoting movement of the shift lever 11 in the clockwise direction about its axis 18 is followed by the retention element 9 rotatably mounted on the shift lever 11. As a result, the blocking arm 9*a* of the retention element or memory lever 9 moves away from the stop pin 2*a* of the pawl 2. Consequently, the retention element or the memory lever 9 can no longer hold the pawl 2 in its raised retention position. The pawl 2 thus returns, spring assisted, to its starting position shown in FIGS. 1A and 2A.

During a closing process of bonnet 4 following the described opening or the first opening process starting from the retention position, the lock retainer pin 3 can now engage with the locking mechanism 1, 2 with any exerted force. This is because the bonnet 4 is in the pre-ratchet position according to FIGS. 2A and 2B in a virtually floating or force-free state relative to the vehicle body. Even in the transition from the retention position of FIGS. 2A and 2B to the retention position shown in FIGS. 3A and 3B, the rotary latch 1 is not pivoted further. As a result, the lock retainer pin 3 still drops into the rotary latch 1 in the retention position as before.

Conversely, this means that following the described first opening operation, a closing operation of bonnet 4 corresponds in any case to the fact that the lock retainer pin 3, without exerting any force, pivots the rotary latch 1 into the pre-ratchet position according to the illustration in FIGS. 2A and 2B. Since previously the pawl 2 has been transferred to its releasing release position and consequently is at its basic position according to FIGS. 1A and 2A, the pawl 2 can drop directly into the pre-ratchet 15 of the rotary latch 1. This applies even if the bonnet 4 is lowered very slowly by an operator and is not acted on with an additional force. Because during this process no spring forces have to be overcome, the lock retainer pin 3 only ensures that the rotary latch 1 is transferred from its open position indicated in FIG. 3A to at least the position belonging to the pre-ratchet position. Since in the pre-ratchet position, the pawl 2 can drop down directly, the lock retainer pin 3 is secured in any case. At the same time, the microswitch or sensor 13 operated in the pre-ratchet position ensures that the previously described warning signal is emitted or subjected to a corresponding evaluation.

The invention claimed is:

1. A motor vehicle bonnet lock system comprising:

a locking mechanism including a rotary latch and a pawl configured to hold and release the rotary latch, wherein the rotary latch comprises first and second arms defining a slot therebetween;

a bonnet having a lock retainer pin engaging in and disengaging from the slot of the rotary latch;

a shift lever that is pivotable about a shift lever pivot axis, wherein the shift lever has a stop arm that abuts the lock retainer pin when the lock retainer pin is engaged in the slot of the rotary latch, whereby the shift lever is configured to follow a movement of the lock retainer pin in and out of engagement in the slot of the rotary latch; and a memory lever, wherein the memory lever is pivotally mounted on a bearing arm of the shift lever and is pivotable about a memory lever pivot axis that is separate from the shift lever pivot axis, wherein the memory lever has a blocking arm that contacts the pawl and a control arm that is engageable against the shift lever, wherein the pivotal mounting of the memory lever on the bearing arm of the shift lever causes the memory lever to follow movement of the shift lever, wherein the pawl engages the first arm of the rotary latch in a closed position to retain the lock retainer pin in the slot of the rotary latch, wherein the memory lever is pivotable to a pre-ratchet position that corresponds to a pre-ratchet position of the pawl in which the pawl is engaged with the second arm of the rotary latch and the lock retainer pin is engaged in the slot of the rotary latch, wherein the memory lever is pivotable to a retention position in which the memory lever holds the pawl in a position in which the pawl is raised away from the rotary latch to release the rotary latch during an unlatching operation of the bonnet, and wherein the lock retainer pin remains engaged in the slot of the rotary latch during the unlatching operation of the bonnet until the unlatching operation is completed.

2. The motor vehicle bonnet lock system according to claim 1, wherein the shift lever projects into an inlet mouth of a frame plate on which the locking mechanism is mounted.

3. The motor vehicle bonnet lock system according to claim 1, wherein the memory lever is biased by a spring in a direction of the retention position.

4. The motor vehicle bonnet lock system according to claim 1, wherein after the pawl has been raised away from the rotary latch to release the rotary latch, the blocking arm of the memory lever is supported by a spring to contact the pawl and hold the pawl in a release position.

5. The motor vehicle bonnet lock system according to claim 1, wherein the blocking arm of the memory lever contacts a stop pin of the pawl to hold the pawl.

6. The motor vehicle bonnet lock system according to claim 1, wherein an unlatching/opening mechanism is provided for acting on the locking mechanism.

7. The motor vehicle bonnet lock system according to claim 6, wherein the unlatching/opening mechanism has a handle provided in an interior of a motor vehicle body, which in a first opening operation, switches the locking mechanism to a pre-ratchet state and, in a second operation, switches the pawl to a release position in which the pawl releases the rotary latch during the unlatching operation of the bonnet.

8. The motor vehicle bonnet lock system according to claim 1 further comprising a sensor that is in communication with the bonnet for detecting closure of the bonnet.

9. The motor vehicle bonnet lock system according to claim 8, wherein the shift lever has a sensor arm that is configured to interact with the sensor depending on a position of the shift lever.

10. The motor vehicle bonnet lock system according to claim 9, wherein the sensor is a microswitch.

11. The motor vehicle bonnet lock system according to claim 2, wherein the pawl has a stop pin which is received through a recess of the frame plate.

12. The motor vehicle bonnet lock system according to claim 1, wherein the memory lever is pivotally mounted on the bearing arm of the shift lever about the memory lever pivot axis.

* * * * *